US011286724B2

(12) United States Patent
Lyagov et al.

(10) Patent No.: US 11,286,724 B2
(45) Date of Patent: Mar. 29, 2022

(54) DRILLING ASSEMBLY WITH A SMALL HYDRAULIC DOWNHOLE MOTOR

(71) Applicant: OBSCHESTVO S OGRANICHENNOI OTVETSTVENNOSTYU "PERFOBUR", Moscow (RU)

(72) Inventors: Alexander Vasilievich Lyagov, Ufa (RU); Ilia Alexandrovich Lyagov, Ufa (RU)

(73) Assignee: OBSCHESTVO S OGRANICHENNOI OTVETSTVENNOSTYU "PERFOBUR", Moscow (RU)

( * ) Notice: Subject to any disclaimer, the term of this patent is extended or adjusted under 35 U.S.C. 154(b) by 20 days.

(21) Appl. No.: 16/957,736

(22) PCT Filed: Dec. 27, 2017

(86) PCT No.: PCT/RU2017/000992
§ 371 (c)(1),
(2) Date: Jun. 25, 2020

(87) PCT Pub. No.: WO2019/132691
PCT Pub. Date: Jul. 4, 2019

(65) Prior Publication Data

US 2020/0332600 A1 Oct. 22, 2020

(30) Foreign Application Priority Data

Dec. 25, 2017 (RU) ..... 2017145614

(51) Int. Cl.
*E21B 7/06* (2006.01)
*E21B 4/02* (2006.01)
*E21B 21/00* (2006.01)

(52) U.S. Cl.
CPC ..... *E21B 7/068* (2013.01); *E21B 4/02* (2013.01); *E21B 21/00* (2013.01)

(58) Field of Classification Search
CPC ..... E21B 4/02; E21B 7/068; E21B 41/0078; E21B 37/00
See application file for complete search history.

(56) References Cited

U.S. PATENT DOCUMENTS 5,195,585 A * 3/1993 Clemens ..... E21B 37/00 166/222
5,458,208 A * 10/1995 Clarke ..... E21B 4/00 175/107
6,189,618 B1 * 2/2001 Beeman ..... E21B 34/14 166/194

FOREIGN PATENT DOCUMENTS

RU 2020292 C1 9/1994
RU 2102575 C1 1/1998
(Continued)

*Primary Examiner* — Giovanna Wright
(74) *Attorney, Agent, or Firm* — Nixon & Vanderhye PC

(57) ABSTRACT

The invention relates to the field of drilling. A packed-hole assembly comprises a drill bit, and a positive displacement motor having a bending unit for deviation by a tilt angle f, and further comprises a rotation module and a hinge module which are rigidly connected to one another, to drill pipes and to the motor by threaded connections. The rotation module consists of a fixed shaft with a central channel and axial openings for drilling fluid, and a rotating body with radial channels which is mounted on cageless rolling contact bearings such as to be capable of circular movement as a result of the reactive force of drilling fluid flowing into the annulus of the borehole through the axial openings in the shaft, the space between the shaft and the rotating body, and the radial channels in turn. The hinge module consists of two half bodies connected to one another by a hinge such as to be capable of rotating freely in an apsidal plane by an angle
(Continued)

e=f, restricted by cams, wherein at least one half body is provided with centering ribs. The result is an increase in penetration rate and bit run rate.

3 Claims, 6 Drawing Sheets

(56) References Cited

FOREIGN PATENT DOCUMENTS

| | | | | |
|---|---|---|---|---|
| RU | 2285106 | C2 | * | 10/2006 |
| RU | 2285106 | C2 | | 10/2006 |
| SU | 939732 | A | | 6/1982 |

* cited by examiner

DRILLING ASSEMBLY WITH A SMALL HYDRAULIC DOWNHOLE MOTOR

This application is the U.S. National Phase of PCT/RU2017/000992 filed on Dec. 27, 2017, which claims priority to Russian Federation Application No. RU 2017145614 filed on Dec. 25, 2017, the entire contents of each of which are hereby incorporated herein by reference.

FIELD OF THE INVENTION

The invention relates to a drilling field, in particular, to the devices working in ultra-small diameter and curvature radius channels (holes) as a component of a packed-hole assembly (PHA), for example, at secondary drilling in a producing zone (PZ) or at workover (WO), and it can be used at drilling with hydraulic downhole motors (DHM) with one or several skew angle units for optimization of their performance, improvement of bottom hole scavenging and chippings transport in the hole annulus to the wellhead and also for shoring channel (hole) walls.

BACKGROUND

It is known a device for stimulation of hole drilling process (USSR inventor's certificate No. 962577 dd 30 Sep. 1982. Bulletin No. 36, the patent holder is Ufa Petroleum Institute), comprising a body of a rock destruction tool (milling bit) with the injection spray system with the channels hydraulically connecting the device body inner cavity with the hole bottom and its annulus to provide movement of drilling fluid with injection. The required flow of the drilling fluid is selected first of all with due regard to optimal performances of the downhole motor and also removal of cuttings and their washover. The latter conditions depend on the changing hole depth and length of the drilling area, and the first one depends on qualitative and quantitative identification of operational dynamics of the bottom-hole assembly made beforehand.

It is known a device for bottom hole scavenging (USSR inventor's certificate No. 802513 dd 7 Feb. 1981. Bulletin No. 5, the patent holder is Ufa Petroleum Institute), comprising flow-type bodies equipped with two jet pumps with the injection channels system hydraulically connecting the device body inner cavities with the hole bottom and its annulus.

It is known a device for borehole cleaning and clogging (Patent RU No. 2313655 (E21 B33/13 the patent holder is N. A. Shamov. No. 2006116200/03, claimed on 12 May 2006; published in 2007. Bulletin No. 36). The device comprises a hollow body with longitudinal and radial channels. There are protective ribs outside the body. There is a radial hole with a nozzle in it in the ribs. The hole annulus is hydraulically connected with the body cavities by means of tangential channels.

The closest analogous device, related to injector devices for a packed-hole assembly, taken as aprototype, is the device "Near-bit ejector pump" (patent RU No. 2020292 dd 30 Sep. 1989, the patent holder is Sergey V. Evstifeev). The known device, incorporated into the drill stem assembly, comprises a flow-type body with centralizers and injection nozzle located in the inclined channels hydraulically connected with spaces above the pump and with a space below it, and the nozzles are located opposite each other in the channels.

The disadvantageous feature of the above said devices is inability to optimize the performance of the hydraulic downhole motor by redistribution of the flow part upstream of the downhole motor, and also inability of the hole walls clogging.

SUMMARY OF THE INVENTION

The technical problem to be solved by the claimed invention is stimulation of drilling the ultra-small diameter and curvature radius channels (holes) by sectional hydraulic downhole motors by means of increasing mechanical and run speed.

The technical result of the invention implementation is extension of capabilities of packed-hole assembly (PHA), which comprises the suggested invention: improving its productivity, reliability and accident-free operation in the ultra-small diameter and curvature radius holes, which is achieved due to the following:

a) performance optimization of the hydraulic downhole motor due to supplying the estimated amount of drilling fluid to it by means of redistribution of the other flow part from the drill stem to the annulus through the injection nozzles installed upstream;
b) decrease of differential (hydrostatic) pressure in bottom-hole zone of drilling bit operation using drilling fluid injection effect;
c) improving the ability of drilling cuttings transportation in the ultra-small diameter and curvature radius holes with a possibility of creating a turbulent flow;
d) hole walls clogging by the drilling fluid flow running out of the injection nozzles tangentially-radially oriented to the hole walls, with the drilling fluid containing additives which reduce risks of bit seizure (including differential) especially at drilling highly deviated, inclined-directed and horizontal holes.

The said technical result is achieved by using a packed-hole assembly with a small-sized hydraulic downhole motor for intensifying drilling in deviated holes, comprising a drilling bit, a positive displacement motor with a skew angle unit at a deviation angle f, wherein the assembly further includes the following equipment rigidly connected with each other, with drill pipes and with the motor through threaded connections:

a) a rotation module for improving a hole annular space washing with a drilling fluid, the rotation module comprising a fixed shaft with a central channel and axial holes for drilling fluid, and a rotating body with radial channels installed on cageless rolling bearings circulatory movable due to reactive force of drilling fluid running out to the hole annular space through the shaft axial holes, space between the shaft and rotating body and radial channels,
b) a joint-hinge module configured to locate the rotation module concentrically with a hole axis and provide an optimal rotation speed of the rotation module body, and also to locate the packed-hole assembly with necessary skew angle units and curvature radius $R_c$ in a apsidal plane of the hole, the joint-hinge module comprising two semibodies connected to each other by a joint freely rotatable in the apsidal plane to an angle e=f, limited by cams, and at least one semibody is equipped with centering ribs.

When implementing the invention, the semibody may contain brasses with ball-shaped surfaces complementary to the joint and seals ensuring leak tightness of the joint-hinge module, and also elastomer for vibration absorbing.

In one embodiment, there is a spacer ring in the joint-hinge module semibody to match joint flexure plane and downhole motor skew angle unit flexure plane with apsidal plane.

The rotation module with the joint-hinge module may be installed at L distance from the drilling bit. This distance is defined taking into account the flexural stiffness of the bottom assembly (EJ) and axial load P generated by the bottom assembly design weight on the drilling bit according to the dependence:

$$L = \pi \cdot \sqrt{\frac{J \cdot E}{P}}.$$

The rotation module may be made in the form of a single-stage or multistage Segner wheel, which body comprises radially-inclined channels and injection nozzles.

To reduce the hydrostatic differential pressure at the bottom of the well, the channels with the rotary module body nozzles are located at inclination angles: the angle $\alpha$=0° . . . 45° to the well axis, and the angle ($\beta$=45° . . . 90°—tangentially) to the body of the equipment.

BRIEF DESCRIPTION OF THE DRAWINGS

Alternative designs of the packed-hole assemblies are shown in the drawings.

DETAILED DESCRIPTION OF THE INVENTION

Figure 1:
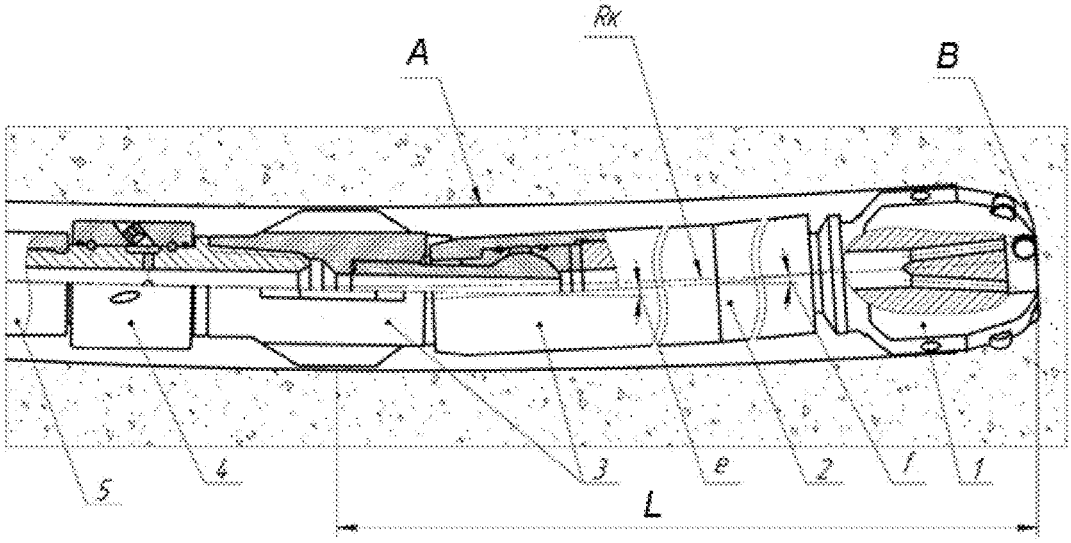
FIG. 1 illustrates an assembly, general view with longitudinal section, comprising, bottom-up, drilling bit (1), positive displacement motor (2) with skew angle unit, made with drift angle (f), located in the hole apsidal plane (drawing plane). The assembly includes the joint-hinge module (3) with limited degree of freedom in the form of drift angle (e) also located in the same plane as the injection-spray rotation module (4). The modules are located in the packed-hole assembly one above the other at the distance (L) from the drilling bit and are connected with drill pipes (5) of certain flexural stiffness (E·J) and with each other—by threads. The hole bottom is indicated by (B) letter, and the hole (channel) walls—by A letter.

Drilling mechanical and run speeds are one of the major factors shaping the drilling engineering-and-economical performance.

Special attention is given to the hole washing system with specified but sufficient volume of fluid for cleaning hole bottom, cooling the drilling bit working units, motors, cuttings washover from the hole when hole walls lining with clogging additives, and ensuring of effective operation of hydraulic downhole motors with strictly specified capacity of mud pumps.

For the purpose of the invention implementation when solving the set problem and achieving the technical result the "Hydraulic Program" of hole (channel) drilling was prepared. This program represents a selection of the downhole motor type, selection of drilling fluid flow rate, and also determination of type and number of pumps providing the required flow rate of the drilling fluid. In the example given the downhole motor type is selected based on the concept—drilling the side radial channel of ultra-small diameter and curvature radius—it is special sectional positive displacement motor 43 mm in diameter.

Drilling fluid is selected taking into consideration the downhole motor performances, since the "pump-motor-hole" system is a whole entity.

Drilling fluid flow rate (mud pump delivery rate) is selected from three conditions.

1. The first condition—cuttings removal. To remove cuttings from the ultra-small diameter hole (channel) bottom, bit diameter is 58 mm, the flow rate 1.7 . . . 2.0 l/s is sufficient.

$$Q_3 \geq q \cdot F_B, \quad (1)$$

where q—fluid specific flow rate required for satisfactory cleaning of the hole bottom; q=0.65 m/c;

$F_B$—bottom area with bit diameter of 58 mm;

$$F_B = \frac{3.14 \cdot 0.058^2}{4} = 0.00264 \text{ m}^2;$$

$$Q_3 = 0.65 \cdot 0.00264 = 0.0017 \text{ m}^3/\text{s}.$$

2. The second condition—cuttings washover. Flow rate of 4 . . . 8 l/s is required for cuttings washover.

$$Q_{min} \geq 15 \cdot U_{sed} \cdot F_{an}, \quad (2)$$

where $$F_{an} = \frac{\pi(d_w^2 - d_{t.min}^2)}{4},$$

—annulus area;

where $d_w$—well bore diameter, $d_{t.min}$—tube minimum diameter $U_{sed}$—sedimentation rate of suspended cutting particles:

$$U_{sed} = \sqrt{\frac{d_e^{max} \cdot (\rho_r - \rho_f)}{\rho_f}}, \quad (3)$$

where $d_e$—particle equivalent diameter, $$d_e^{max} = (0.002 + 0.037) \cdot D_b, \quad (4)$$

where $D_b$—bit diameter of 58 mm;

$\rho_r$—density of drilled rock; $\rho_r$=2500 kg/m$^3$, $\rho_f$—density of drilling fluid $\rho_f$=1050 kg/m$^3$, $$d_e^{mx} = 0.002 + 0.037 \cdot 0.058 = 0.004146 \text{ m};$$

$$U_{sed} = 4 \cdot \sqrt{\frac{0.004 \cdot (2500 - 1050)}{1050}} = 0.29 \text{ m/s};$$

$$F_{an} = \frac{3.14 \cdot (0.058^2 - 0.028^2)}{4} = 0.002 \text{ m}^2;$$

annulus area;

$$Q_{min} \geq 15 \cdot 0.29 \cdot 0.002 = 0.0087 \text{ m}^3/\text{s}.$$

3. The third condition—ensuring optimal operation of PDM (positive displacement motor). Special PDM 2D-43.5/6.21.010, which maximum flow rate is 2 l/s, are used when drilling perforation channels.

Since for the purpose of cuttings washover the pump delivery rate shall be minimum 4 l/s, and this amount exceeds the amount required for PDM, it is necessary to "dump" the excess part of drilling fluid upstream of PDM through the special rotation module. Thus, the required delivery to the hole bottom for cuttings removal is ensured, and total flow rate in the annulus, taking into account the delivery through the special injection device, exceeds 4 l/s. Additional "transportation" characteristics of the drilling fluid are controlled by rendering the fluid with special thixotropic properties, which enable to washover cuttings to daylight surface, when washing the hole, and to maintain them suspended in case of pump stop. Provided that, the yield point shall be within the range from 0.3 to 13 Pa, and the minimum permitted plastic viscosity shall be 0.004 Pa·s.

In order to ensure the circulation of washing agent of the given amount (4-8 l/s) the mud pump shall build up a pressure sufficient to overcome hydraulic resistances occurred in all elements of Perfobur's circulation system. When drilling a radial channel 58 mm in diameter and 15 m long in the hole at a depth of 3000 m, the total pressure difference will be within the range 15-17 MPa.

The pump for drilling a radial channel was selected based on the required delivery characteristics and generated pressure, and also on availability of the adjustable drive for pump smooth delivery. The pumping unit SIN46 is the most suitable of the options considered.

Pumping Unit SIN 46.03

Purpose—High pressure pumping of different fluids and polymer solutions in continuous duty. It is used for pumping water (in reservoir pressure maintenance systems), drilling fluids, cement grouts, polymer solutions, oils and other process liquids.

Configuration:

Induction motor 132 kW, 1500 rpm

Motor speed frequency regulator

Triplex plunger pump SIN46

Control panel with monitoring system

Pulsation dampener

Planetary gear reducer SIN42

Frame

Specifications:

| | | | | | |
|---|---|---|---|---|---|
| Motor power*, kW | 132 | 132 | 132 | 132 | 132 |
| Plunger diameter, mm | 45 | 55 | 65 | 75 | 100 |
| Maximum pressure, MPa | 40 | 23 | 16 | 12 | 7 |
| Maximum ideal delivery rate, m$^3$/h (m$^3$/day) (the pump shaft rotation speed is 300 rpm) | 11 (264) | 16.5 (236) | 23 (552) | 30.6 (734) | 54.4 (1305) |
| Reducer speed ratio | | | 5 | | |
| Overall dimensions (max), mm | | | 2680 × 1930 × 1270 | | |
| Weight, kg | | | 2600 | | |

The device operates as follows.

The drill stem assembly (DSA) is assembled. It comprises (bottom-up): drilling bit corresponding to the rock type; small sectional hydraulic downhole motor (DHM) with one or several skew angle units; drill pipes of the required flexural stiffness (E·J) and effective length, (for the purpose of optimal placement in DSA the current invention is modular, and, if necessary, injector-jointed downflow module (IJDFM) is installed in DSA directly above DHM or, for example, at L distance from the bit. The joint-hinge module drift angle is installed in the same apsidal plane with the DHM skew unit angle(s); and then drill pipes of the required schedule-size with the units for drilling according to the supposed technique. As the DSA is assembled it runs in the hole.

Mud pump delivers drilling fluid (Newtonian or Bingham, etc.) into DSA with the required flow rate, for example, $Q_1$, depending on bottom-hole depth, to wash over the expected volume of cuttings broken down by a bit of certain type (scraping-cutting, chipping-crushing, etc.), and most importantly to optimize DHM performance, provided that the following conditions shall be fulfilled:

a) evaluate a possibility of effective cleaning the hole bottom, cooling the bit and providing the sufficient speed of upward flow with cuttings in the annulus as of the channel as further in the hole taking into account head drag coefficient and suspension velocity;

σ) take into account the rheological properties of a drilling fluid and hole bottom pressure with due regard to enrichment with broken rock;

в) optimize DHM performance.

When producing an axial load on a bit by unloading part of the weight of the compressed PHA to the required value, the joint-hinge module, when deviating, touches the walls of the inclined-directed hole with its semibody's ribs providing the maximum concentric position of the jet rotator body about the hole axis.

As a rule, when drilling space orientation holes a deflecting force occurs on the bit as result of PHA longitudinal flexure when producing an axial load close to critical value (Euler), and it becomes impossible to drill a hole (channel) along the expected trajectory even in isotropic rocks.

Besides, PHA flexure without a "joint" could result in wall friction of the rotation module body, or in order to avoid such risks it will be necessary to limit its diametral dimensions, i.e. reduce the device function parameters.

For the purpose to eliminate a possibility of wall friction of the rotating body a joint-hinge module with guaranteed drift angle and equipped with centering ribs is installed in IJDFM. It enables to place Segner wheel maximum concentrically about the hole axis, i.e. with the required clearance with respect to its walls, to achieve high probability of the wheel rotation with optimal speed and to take away the flexure moment (E·J) from the drill pipes loaded by the compressed part axial force.

Place of the "joint" installation (L) is selected upstream of the rotation module starting from the bit:

$$L = \pi \cdot \sqrt{\frac{J \cdot E}{P}} = 2.08 \text{ m at axial load } P = 2000 \text{ H}, \tag{5}$$

and L=1.20 m at axial load P=6000 N, i.e. immediately above the small sectional hydraulic downhole motor, where E—Young modulus of PHA material (e.g. for chrome-nickel steel, $E=2.1\cdot10^6$ kgf/cm$^2$);

J—reduced polar moment of inertia of PHA compressed part;

P—axial load on DHM 43 mm in size (2000-6000 N).

Drilling fluid flow rate $Q_1$ is divided by calculation into two flows: one is consumed for DHM operation—$Q_2$ (specified flow rate according to DHM specification) and the other one—$Q_3$ is supplied for IJDFM operation. Wherein, the diameters of IJDFM injection nozzles are selected from conditions that the pressure difference in them (taking into account their number) is less than pressure losses in DHM (nameplate data) and in the bit nozzles, subject to providing the conditions of Segner wheel rotation and producing a swirling flow in the channel (hole) annulus at dynamic outflow of drilling fluid from the nozzles.

Figure 12:
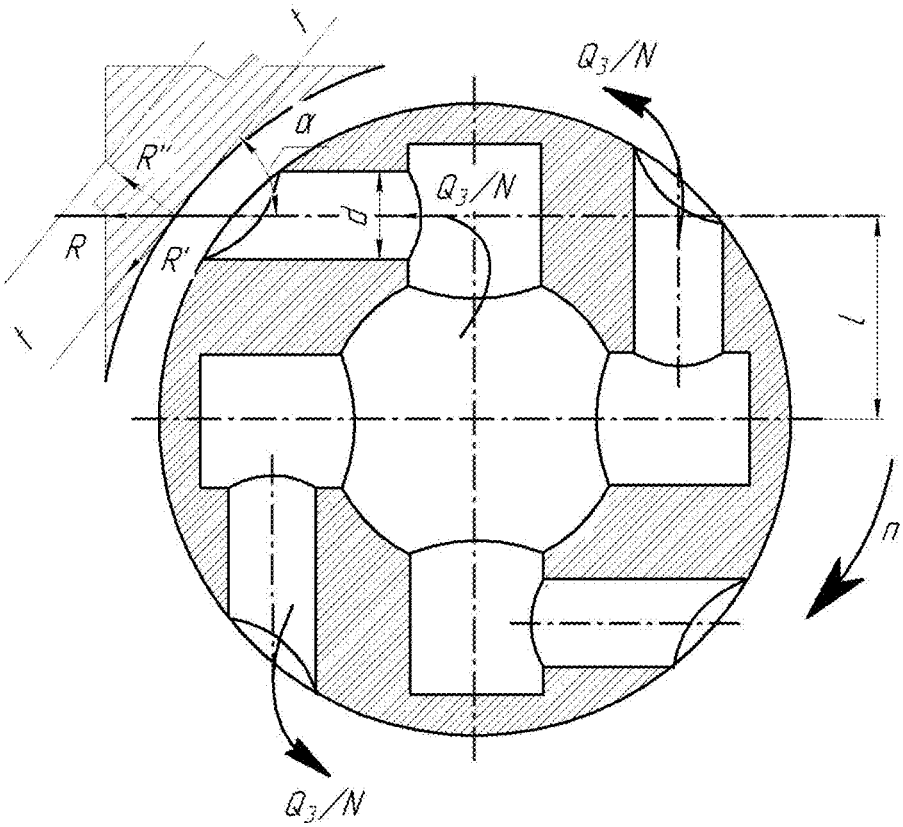
FIG. 12 illustrates a scheme to Segner wheel design calculation.

Let us consider a problem on determination of driving torque and operating speed of the rotation module made in the form of a single-stage Segner wheel (see FIG. 12).

Reactive force of the fluid flow $Q_3$, outflowing from the nozzles, is determined by the expression:

$$R = \frac{Q_3 \cdot \rho}{N} \cdot (u - V_N), \tag{6}$$

where $Q_3$—fluid flow to the Segner wheel drive;

ρ—density of working fluid;

u—fluid jet velocity at the nozzle outlet;

$V_N$—circumferential nozzle speed.

Plugging into (6) expression for speeds we obtain the following expression $$R = \frac{Q_3 \rho}{N} \cdot \left(\frac{Q_3}{N \cdot \mu \cdot f} - \frac{\pi \cdot n \cdot l}{30}\right),$$

where N—number of nozzles;

μ—nozzle flow coefficient;

f—outlet sectional area of one nozzle;

l—distance from nozzle axis to wheel rotation axis.

Segner wheel driving torque is determined as follows:

$$M_{eng} = NRl = Q_3 l \rho \cdot \left(\frac{Q_3}{N \cdot \mu \cdot f} - \frac{\pi \cdot n}{30} l\right). \tag{7}$$

Let us reduce the obtained expression (7) to the form similar to Euler equation for turbo machines.

Then we obtain:

$$M_{eng} = M_{brake}(1 - n/n_{max}) \tag{8}$$

where $M_{brake}$—torque at braking condition (start torque);

$n_{max}$—wheel speed at idle run, calculated according to the following dependencies:

$$M_{brake} = \frac{Q_3^2 \rho l}{N \cdot \mu \cdot f}, \tag{9}$$

$$n_{max} = n \frac{30 \cdot Q_3}{N \cdot \pi \cdot \mu \cdot f \cdot l} \tag{10}$$

When fluid jet outflowing from the nozzle hits against the hole wall cammed surface, at a first approximation it could be divided into two components R' and R" (FIG. 1)

$$\vec{R} = \vec{R}' + \vec{R}'', \tag{11}$$

R'—rotational force, R"—hole wall clogging force.

At the point of jet hitting against wall the angle between tangent t-t to surface and axis equals α. In this case we finally obtain from (8) as follows:

$$M_{eng} = M_{brake} \cdot (1 - n/n_{max}) \cdot \sin \alpha \tag{12}$$

graphically the expression (12) represents an inclined line, crossing Y-axis in the point $M_{brake}$, and X-axis—in the point $n_{max}$.

As an example, let us define the $M_{brake}$ and $n_{max}$ value for a single-stage Segner rotator concentrically placed in the PHA. Let us apply the following data for calculation: $Q_3$=4 l/s; μ=0.9; f=0.9·$10^{-5}$ $m^2$ (N=4–number of nozzles d=3 mm); l=15 mm; ρ=1050 kg/$m^3$.

As a result of calculation according to (9) and (10) we obtain:

$M_{brake}$=7.77 N·m, that is sufficient to break friction in rolling bearings and overcome resistance of drilling fluid;

$n_{max}$=803.3 $min^{-1}$, that is sufficient to produce strong swirling flow in the annulus, wherein, as one can see from (10), when reducing the nozzle number N=2, $n_{max}$ increases twice with the flow rate remained unchanged.

Figure 2:
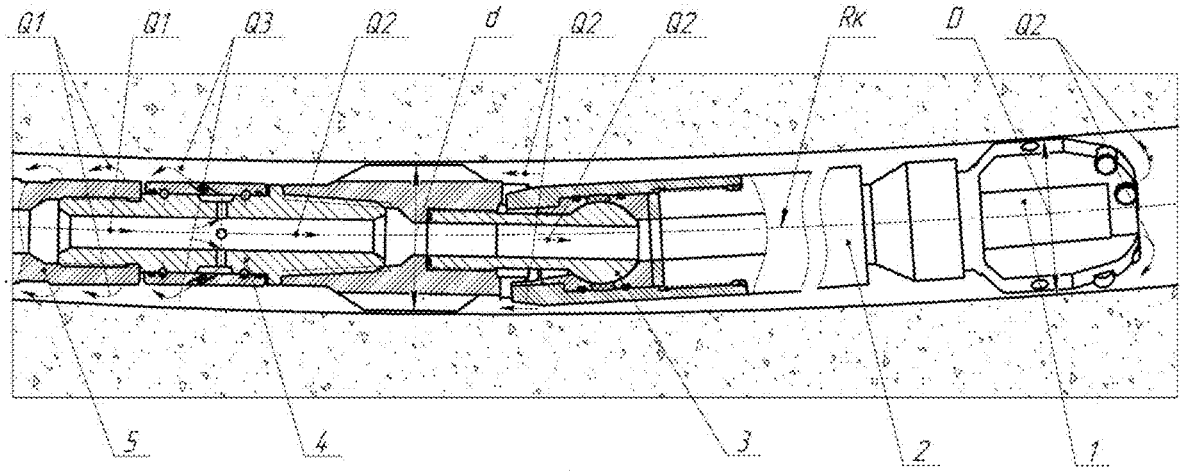
FIG. 2 illustrates a longitudinal section of the packed-hole assembly. Flow rate and direction of drilling fluid pumped by surface mud pump are indicated. In the inner axial channel of the packed-hole assembly the flow rate is $Q_1$, in the rotation module channel—$Q_2$, in the channels and holes of the "downflow" part injection module—$Q_3$, in the hole bottom—$Q_2$ and in the hole annulus in the downhole motor area—$Q_2$, in the area of the packed-hole assembly $Q_3+Q_2=Q_1$.
Figure 4:
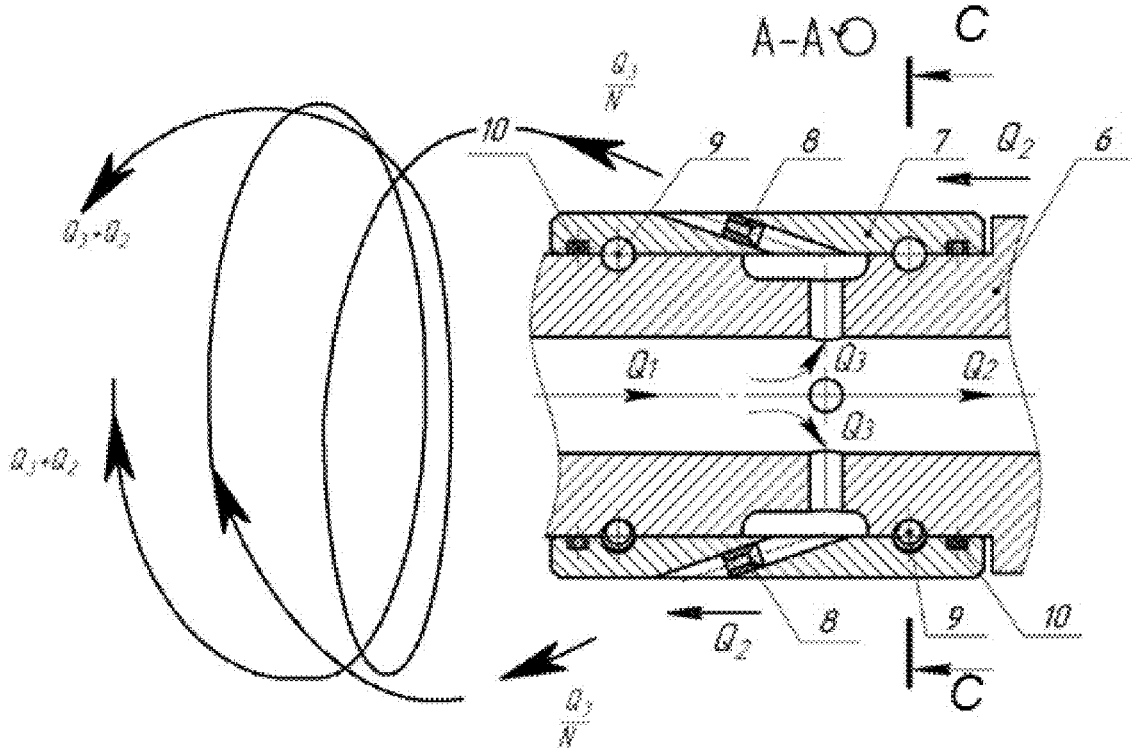
FIG. 4 illustrates a fragment through the section A-A, shown in FIG. 3, of location of the rotating body (7) with injection (hard-alloy) nozzles (8) installed in the body radially-inclined channels "tangentially-slantingdicularly" and upwards into the annulus to the drill stem for the body reactive rotation and decreasing the differential pressure in the hole bottom, on the flow-type shaft (6). The body (7) is located on cageless rolling bearings (9) with seals (10) and made in the form of a single-stage high speed Segner wheel with low circulation ratio, N—quantity of nozzles: 8.
Figure 5:
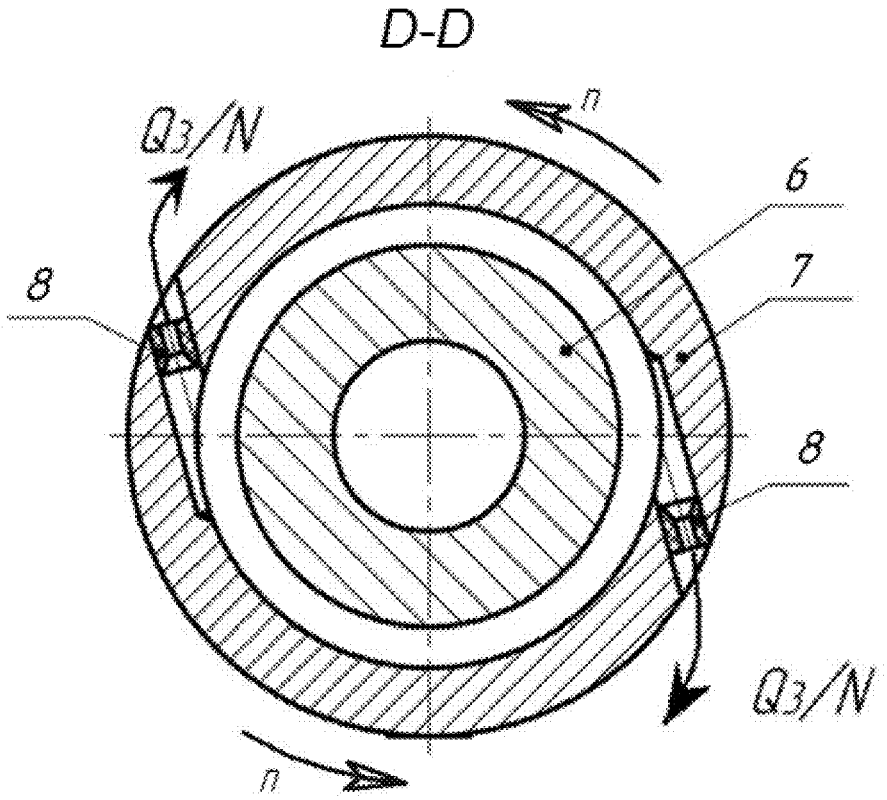
FIG. 5 illustrates a fragment through the section D-D, shown in FIG. 3, of location of the rotating body (7) with injection (hard-alloy) nozzles (8) installed in the body radially-inclined channels "tangentially-radially" to the hole walls to achieve their clogging effect and to rotate drilling fluid "downflow" part in the hole (channel) annulus, configured to implement "Maximum Flow Principle", on the flow-type shaft (6) with radial channels.
Figure 6:
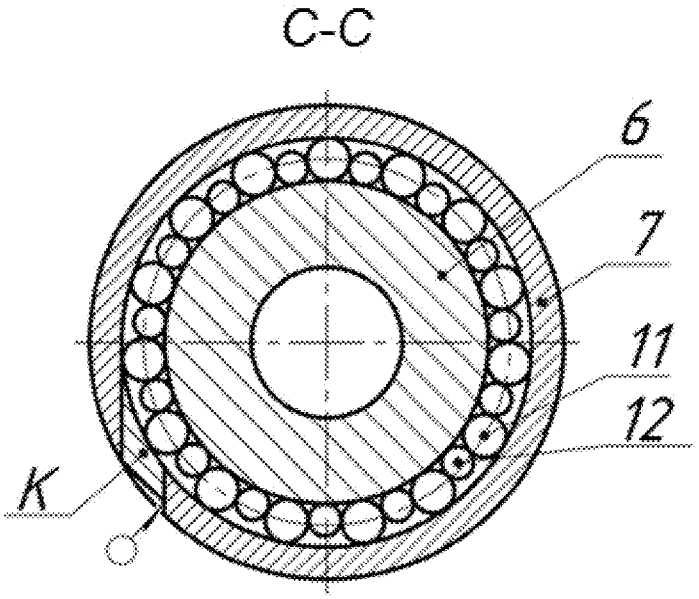
FIG. 6 illustrates a fragment through the section C-C, shown in FIG. 4, of location of the body (7) on cageless rolling bearings, made with alternation of large (11) diameter and smaller diameter (12) balls, while the latter can work as separators. Ball plug is specified with K letter.
Figure 7:
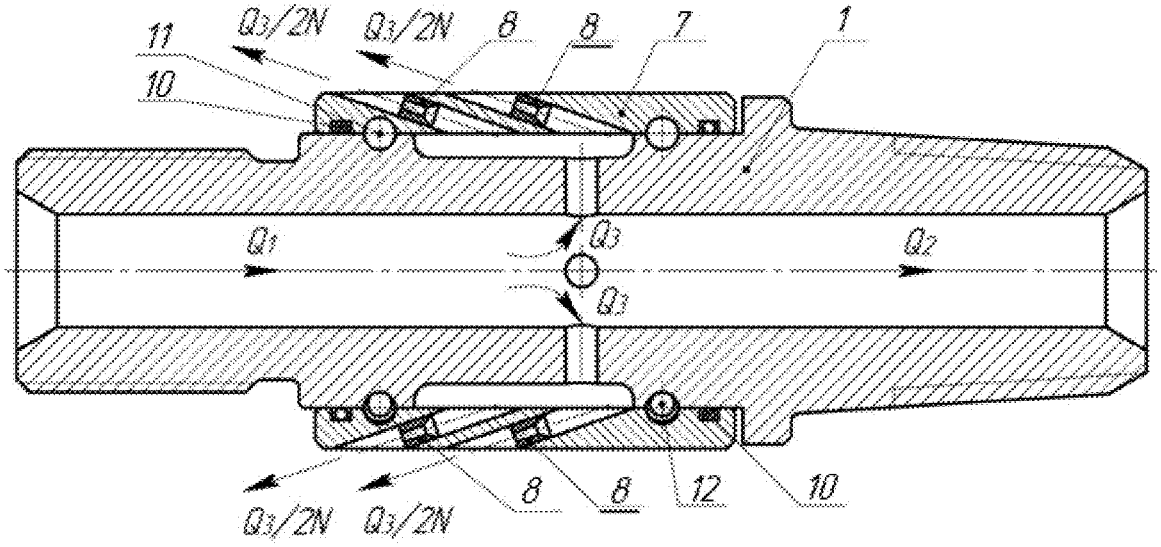
FIG. 7 illustrates the rotation module made in the form of two-stage high speed Segner wheel with low circulation ratio and two rows of injection nozzles (8) in the body (7) located on the bearings (11) and (12) with seals (10).
Figure 8:
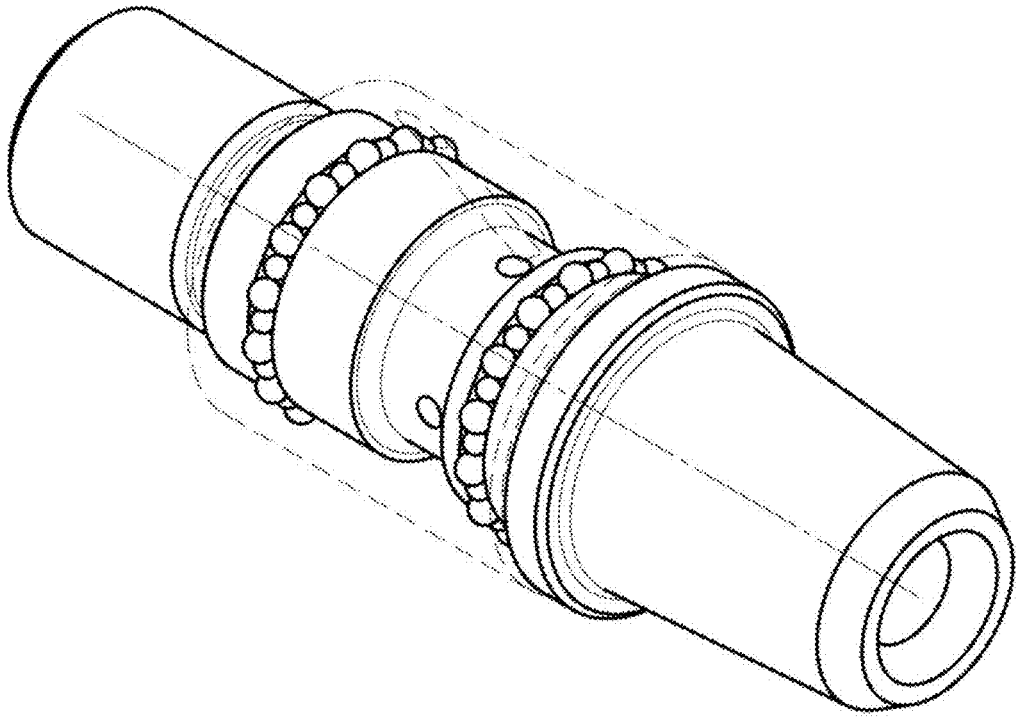
FIGS. 8 and 9 illustrate axonometric and 3D view of the injection-spray rotation module respectively.
Figure 9:
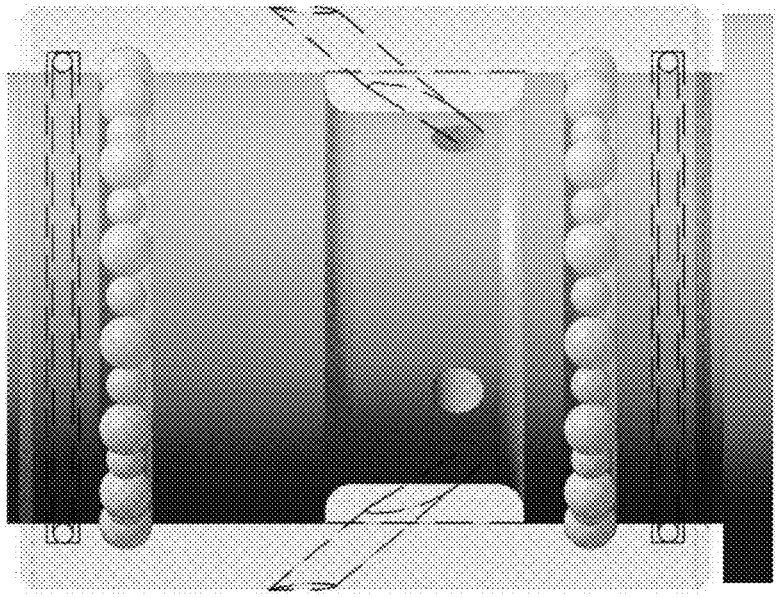
Figure 10:
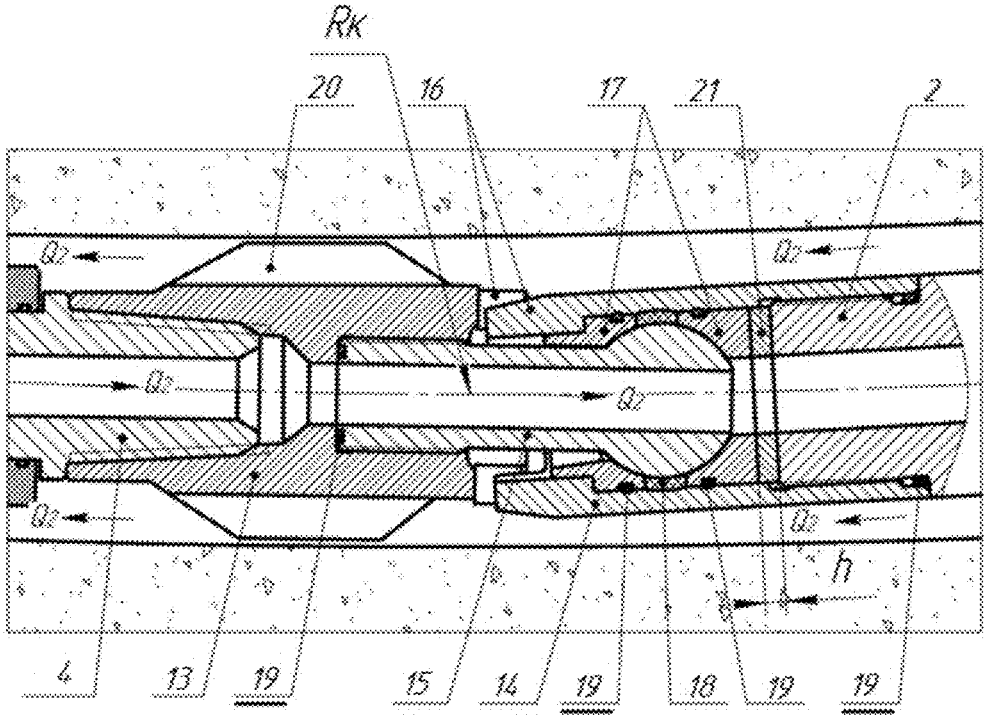
FIG. 10 illustrates the joint-hinge module shown in FIGS. 1 and 2, comprising two semibodies, upper (13) and lower (14), connected by the joint (15) and interacting cams (16). The semibody (14) contains brasses (17) with ball-shaped surfaces complementary to the joint and vibration absorbing elastomer. The joint-hinge module is hermetically-sealed by the seals (19). There are centering ribs (20) on the upper semibody (13). The joint-hinge module is installed at a certain distance from the drilling bit (not shown) and above the downhole motor (2) upstream of the rotation module (4) by means of threaded connections. Converse installation is also possible. The spacer ring (21) of designed height h is selectively installed in the lower semibody (14) to provide an ability to locate the joint drift angle exactly in the same apsidal plane with the downhole motor skew unit angle.
Figure 11:
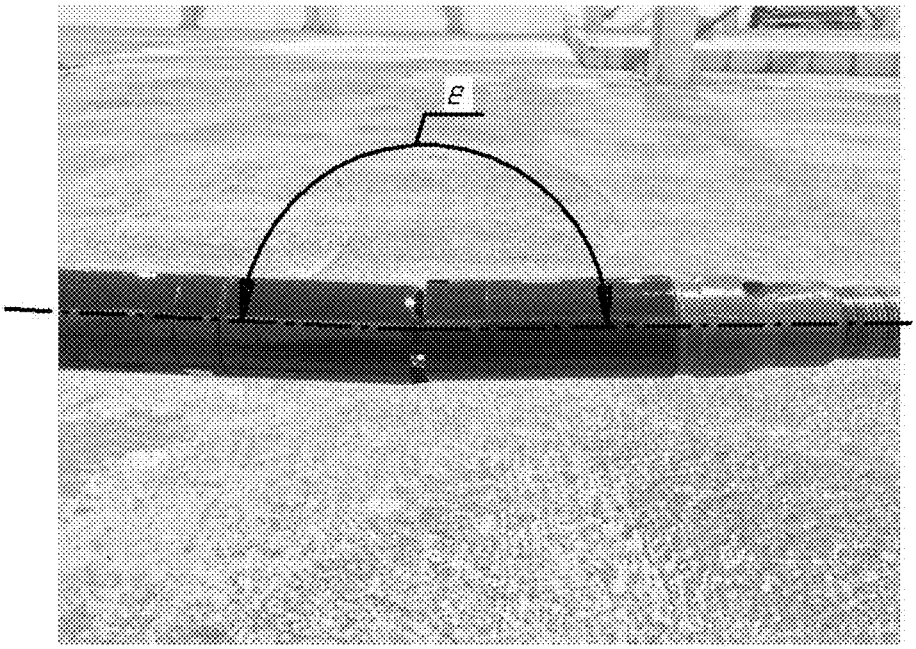
FIG. 11 illustrates a photo of one of the design embodiments of the metal packed-hole assembly for bench tests, when making an analysis of drilling fluid flows redistribution volumes.

It is obvious that actual speed of the rotation module body will be slightly different from the design value due to mechanical friction in seals and rolling bearings and also due to hydraulic friction of the rotator body surface, rotating in viscous medium, and due to losses caused by flow turbulence and swirling at vortex formation in the annulus between the rotator and hole wall (see FIGS. 2, 4 and 5).

Drilling fluid flow $Q_3$, outflowing from the nozzles at a high speed, according to Bernoulli's theorem, decreases pressure at nozzles outlet in the hole annulus, which is transferred to the hole bottom that decreases hydrostatic (differential) pressure in bottom-hole zone and improves its cleaning due to additional injecting the flow $Q_2$, that promotes increasing of mechanical drilling speed.

Flows $Q_2$ and $Q_3$ are mixed in the hole annulus, swirled by Segner wheel with vortex formation, that promotes injection thrust boost in the annulus with possible implementation of "Maximum Flow Principle" included in the discovery "Regularities of fluid flow rate in swirling flow", clean the channel walls and improve cutting carrying capacity to surface. This regularity is confirmed at bench tests of the packed-hole assembly with c IJDFM device on the test bench of Perfobur LLC, when drilling curved channels 6-10 m long by special small positive displacement motors in sand-cement blocks at a speed 1.5-2 times higher as compared to the speed without the current invention.

Figure 3:
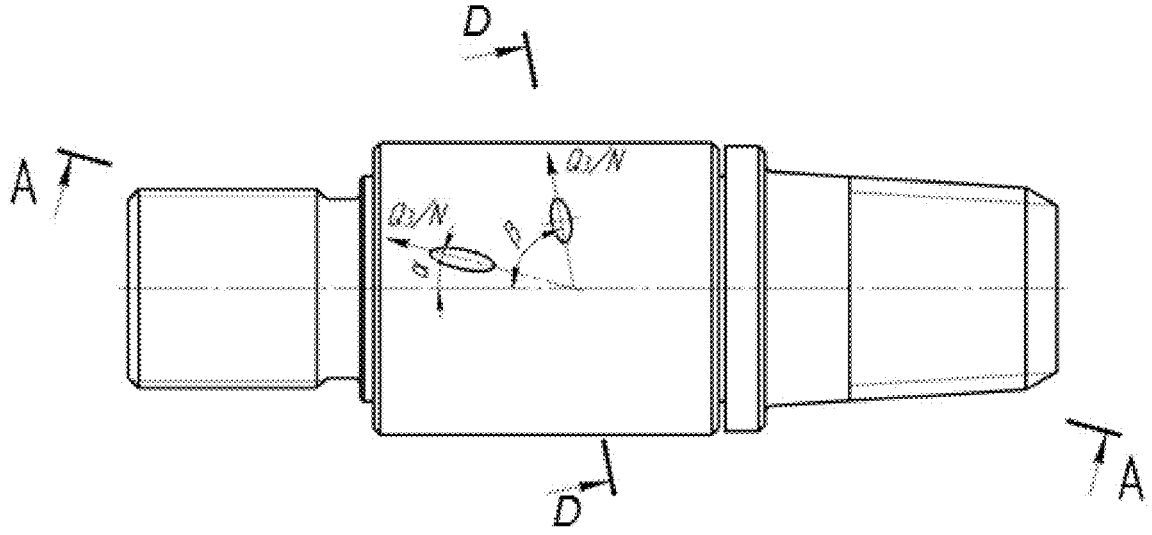
FIG. 3 illustrates external view of the rotation module (4), shown in FIG. 1 and FIG. 2 with indication of drilling fluid "downflow" parts movement direction: $Q_3$/N, with direction ($\alpha$) through the section A-A "tangentially-slantingdicularly" and upwards, into the annulus to the drill stem for the body reactive rotation and decreasing the differential pressure in the hole bottom, and simultaneously with direction ($\beta$) through the section D-D "tangentially-radially" to the hole walls to achieve their clogging effect in addition.

"Downflow" part of drilling fluid $Q_3$ with different particulate composites (e.g. marble chips), swirled by the rotation module and directed by the nozzles tangentially-radially to the hole walls, promotes cleaning the borehole wall off potentially formed filter cake and immediately plugs it with generated vortex field with dispersed phase of drilling fluid directed by radially oriented nozzles when the rotation module is multi-staged (FIG. 3 и 7). Hydrodynamic pressure fluctuations at outflow and hitting of drilling fluid jets promote intensive filling the hole wall pores and cracks with micro-fine clogging mud solids that improves hole walls integrity and stability. Bench tests have demonstrated that the clogging screen thickness can be 3-5 mm. This value withstands the pressure difference up to 5-7 MPa, that with high probability will exclude possible risks of PHA differential seizure, hence, reduce time for their elimination, i.e. increase drilling run speed.

The invention encloses several embodiments, which differ from each other by design features of one- or multi-staged rotation module by changing number of channels with body nozzles and also their location.

Multi-staged rotation module assembly when using clogging drilling fluid (for example, with addition of micro-fine marble chips) and with nozzles directed in a specific way: for example, some nozzles tangentially oriented to the hole walls, which in addition to Segner wheel rotation effect will clean the hole walls off filter cake due to swirled vortex flow, and the other nozzles, radially oriented, will enable immediate plugging with bridging agents in vortex wavefield using activated dispersed phase of drilling fluid.

The invention claimed is:

1. A packed-hole assembly with a small-sized hydraulic downhole motor for intensifying drilling in deviated holes, comprising a drilling bit, a positive displacement motor with a skew angle unit at a deviation angle f, wherein the assembly further includes the following equipment rigidly connected with each other, with drill pipes and with the motor through threaded connections:

a) a rotation module for improving a hole annular space washing with a drilling fluid, the rotation module comprising a fixed shaft with a central channel and axial holes for drilling fluid, and a rotating body with radial channels installed on cageless rolling bearings circulatory movable due to reactive force of drilling fluid running out to the hole annular space through the shaft axial holes, space between the shaft and rotating body and radial channels, and b) a joint-hinge module configured to locate the rotation module concentrically with a hole axis and provide an optimal rotation speed of the rotation module body, and also to locate the packed-hole assembly with necessary skew angle units and curvature radius $R_c$ in a apsidal plane of the hole, the joint-hinge module comprising first and second semibodies connected to each other by a joint freely rotatable in the apsidal plane to an angle e=f, limited by cams, and at least the first semibody is equipped with centering ribs;

wherein the second semibody contains brasses with ball-shaped surfaces, complementary to the joint, and seals ensuring a leak tightness of the joint-hinge module, and also an elastomer for vibration absorbing;

wherein there is a spacer ring in the joint-hinge module second semibody to match joint flexure plane and downhole motor skew angle unit flexure plane with apsidal plane; and wherein the rotation module with the joint-hinge module are installed at L distance from the drilling bit, wherein distance L is defined taking into account a flexural stiffness of an bottom assembly (EJ) and axial load (P) generated by bottom assembly design weight on the drilling bit according to the following dependence: L=

$$L = \pi \cdot \sqrt{\frac{J \cdot E}{P}}.$$

2. The packed-hole assembly according to claim 1, wherein the rotation module is made in a form of a single-stage or multistage Segner wheel, wherein a body of the rotation module contains radially-inclined channels and injection nozzles.

3. The packed-hole assembly according to claim 2, wherein for decreasing hydrostatic pressure at a downhole, the radially-inclined channels and the injection nozzles of the rotation module body are located at a slope angle α from 0° to 45° with the hole axis and at straight and gently inclined angle β from 45° to 90° and at a tangent to the rotation module body.

* * * * *